United States Patent [19]

Shiraki et al.

[11] Patent Number: 4,861,237

[45] Date of Patent: Aug. 29, 1989

[54] AXIAL-FLOW FAN APPARATUS

[75] Inventors: Manabu Shiraki; Kazuhito Egami, both of Yamato, Japan

[73] Assignee: Shicoh Engineering Co., Ltd., Kanagawa, Japan

[21] Appl. No.: 921,396

[22] Filed: Oct. 22, 1986

[30] Foreign Application Priority Data

Nov. 7, 1985 [JP] Japan ..... 60-171260[U]

[51] Int. Cl.[4] ..... F04B 17/02

[52] U.S. Cl. ..... 417/353; 417/423.7; 310/68 R

[58] Field of Search ..... 417/353, 423 F, 423 G; 310/67, 68, 68 R, 268

[56] References Cited

U.S. PATENT DOCUMENTS

| | | | |
|---|---|---|---|
| 4,203,048 | 5/1980 | Sato | 310/268 |
| 4,315,363 | 2/1982 | Barone | 29/596 |
| 4,361,776 | 11/1982 | Hayashi et al. | 310/268 |
| 4,499,391 | 2/1985 | Sakamoto | 310/89 |
| 4,504,751 | 12/1985 | Meier | 310/62 |
| 4,553,075 | 11/1985 | Brown et al. | 310/68 R X |
| 4,554,473 | 11/1985 | Müller | 310/67 R |
| 4,588,912 | 5/1986 | Shinmura et al. | 310/68 R |
| 4,620,139 | 10/1986 | Egami et al. | 310/68 R X |
| 4,626,727 | 12/1986 | Janson | 310/67 R X |

FOREIGN PATENT DOCUMENTS 0111443 11/1983 European Pat. Off. .

OTHER PUBLICATIONS

Patent Abstracts of Japan, vol. 9, No. 140 (E-321) [1863], Jun. 14, 1985 & JP-A-60 22 446 (Ricoh K. K.), 04 02 1985.

European Search Report EP 86 11 4713.

*Primary Examiner*—Leonard E. Smith

*Assistant Examiner*—Eugene L. Szczecina, Jr.

*Attorney, Agent, or Firm*—Wegner & Bretschneider

[57] ABSTRACT

A light-weighted, inexpensive axial-flow fan apparatus which can prevent axial leakage of a magnetic flux of a brushless motor installed therein. A body member of the apparatus or a motor casing on which the motor is supported is made of a non-magnetic material such as a resin material, and a name plate formed from a magnetic seal is applied to the bottom of the motor casing so as to pass a magnetic flux therethrough.

1 Claim, 3 Drawing Sheets

AXIAL-FLOW FAN APPARATUS

BACKGROUND OF THE INVENTION

1. Field of the Invention

This invention relates to a very light-weighted axial-flow fan apparatus suitably used for various machines and devices.

2. Description of the Prior Art

Normally, an axial-flow fan apparatus includes a single-phase energized brushless motor (where it includes a two phase arrangement of armature coils, it is sometimes called a two phase motor, but it is accurate to call it a single-phase motor due to its energizing method) installed in a motor casing located in a body of the fan apparatus.

Thus, as various machines and devices such as business machines have been developed, axial-flow fan apparatus are required to be very light-weight, very inexpensive, very small and very flattened.

One axial-flow fan apparatus which meets such requirements is an axial-flow fan apparatus in which a flattened single-phase energized coreless brushless motor which necessitates only one position detecting element is installed in a motor casing of the apparatus.

Such a flattened single-phase energized coreless brushless motor can be very thin and light-weight due to its coreless, flattened configuration and can be very inexpensive because it includes only one position detecting element and a single-phase energized controlling circuit and hence its energization controlling circuit is simple.

In a single-phase brushless motor of the type, there is a so-called dead point at which energization to armature coils is switched and no torque (starting torque) is generated by the motor. Thus, such a single-phase brushless motor has a drawback that it cannot start itself if a rotor field magnet of the motor is just at a dead point upon starting of the motor. Therefore, a single-phase energized brushless motor is normally provided with a cogging generating magnetic member (an iron piece or a magnet) cooperating with a field magnet for generating a cogging torque in addition to an armature torque generated by an armature coil and the field magnet in order to prevent the torque at such dead points from reducing to zero to allow self-starting of the motor.

This applies not only to a single-phase brushless motor of the cored type but also to a single-phase brushless motor of the coreless type.

Here, it is desirable to employ a flattened single-phase energized coreless brushless motor in order to obtain an inexpensive, light-weight, very flattened axial-flow fan apparatus, and in order to obtain a more inexpensive, more light-weight, more flattened axial-flow fan apparatus, it is desirable to employ a flattened coreless brushless motor which includes no stator yoke therein.

However, where a flattened single-phase coreless brushless motor which includes no stator yoke therein is employed in an axial-flow fan, apparatus magnetic flux from the magnet rotor (field magnet) will leak axially (toward a bottom of a body of the axial-flow fan apparatus) due to the absence of a stator yoke. Accordingly, if such an axial-flow fan apparatus is used for a particular apparatus for an object such as cooling, there is the possibility that such leakage of flux will have a bad influence on apparatus or devices around the apparatus. This phenomenon readily appears particularly where the body (particularly a motor casing) of the axial-flow fan apparatus is made as a non-magnetic member. Leakage of a magnetic flux appears frequently where a single-phase energized brushless motor employed in an axial-flow fan apparatus is of flattened coreless brushless type.

In order to prevent such leakage of magnetic flux, a body or a motor casing of an axial-flow fan apparatus may be made of a magnetic material. However, this will make the axial-flow fan apparatus heavy, and it will be very inconvenient to incorporate it in a housing of a particular type. To the contrary, in order to minimize the weight and further reduce the cost, a body and a motor casing of an axial-flow fan apparatus may desirably be made integrally of a resin material. Further, it is desirable to omit a stator yoke. However, this will lead to a drawback that leakage of a magnetic flux will appear.

SUMMARY OF THE INVENTION

It is an object of the present invention to provide an axial-flow fan apparatus which is light in weight and thus inexpensive and in which axial leakage of magnetic flux can be prevented without special means.

In order to attain the object, according to the present invention, there is provided an axial-flow fan apparatus, comprising a body member, a brushless motor mounted on said body member, a fan mounted for rotation by said brushless motor, said body member being formed from a non-magnetic material such as a resin material, and a name plate formed from a magnetic seal and applied to a bottom face of said body member to prevent axial leakage of a magnetic flux.

Thus, the name plate in the form of a magnetic seal applied to the bottom face of the body member of the axial-flow fan apparatus passes or conducts magenetic flux therethrough and hence prevents such magnetic flux from axially leaking from the apparauts or the motor. A seal name plate formed of a non-magnetic material such as paper or aluminum foil on which required indications such as an indication of a name of a manufacturer or a model of an axial-flow fan apparatus are provided is commonly applied to an outer bottom face, especially of a motor casing, of the apparatus. Accordingly, only if such a seal name plate is made from a magnetic seal, can it be used as a name plate in an axial-flow fan apparatus according to the present invention.

Accordingly, if a motor casing or the body member of the apparatus is made of a non-magnetic material such as a resin material in order to minimize the weight and production cost of the axial-flow fan apparatus, axial downward leakage of magnetic flux from the apparatus or the motor casing can be efficiently prevented by such a name plate in the form of a magnetic seal applied to the bottom of the apparatus body member or the motor casing.

DESCRIPTION OF THE PREFERRED EMBODIMENTS

Figure 1:
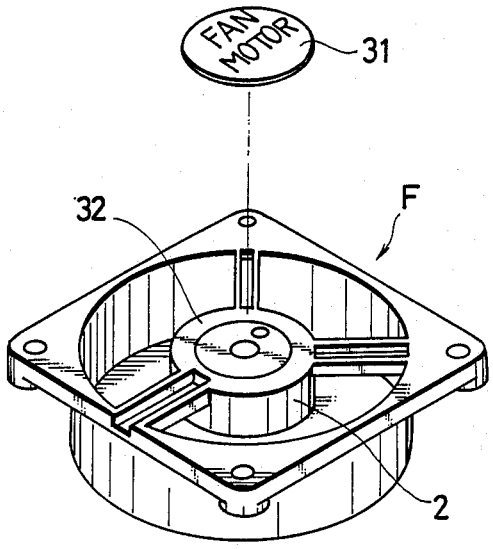
FIG. 1 is an overall perspective view of a magnetic seal name plate to be applied to an angular motor casing of an axial-flow fan apparatus according to the present invention.
Figure 2:
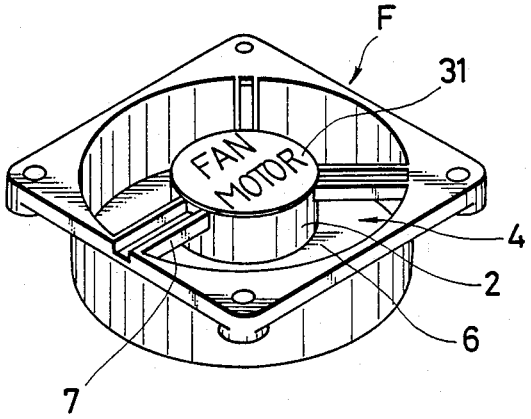
FIG. 2 is a perspective view of the axial-flow fan apparatus of FIG. 1 with the name plate applied to the motor casing.

Referring first to FIGS. 1 and 2 which are perspective views as viewed obliquely from below, an axial-flow fan apparatus generally denoted at F includes a name plate 31 in the form of a magnetic seal applied to an outer bottom face of the apparatus, particularly to a bottom face 32 of a motor casing 2. In FIG. 1, the magnetic seal name plate 31 is shown not yet applied while it is shown applied in FIG. 2. In both figures, a cup member with fan blades is not shown mounted in position.

The magnetic seal name plate 31 may have an indication of a model, a name of a manufacturer and/or a color of the motor F provided on a surface thereof and has an adhesive (not shown) applied on the other side of the seal name plate 31 as in a conventional non-magnetic seal. Such magnetic seal name plates are normally held in a large number on a removable paper base and are peeled off one by one to be used. Thus, a magnetic seal name plate 31 may be arranged on the outer bottom face of a motor casing 2 as seen in FIG. 1 and then applied to a bottom face 32 of the motor casing 2 as shown in FIG. 2. Thus, leakage of magnetic flux axially below the axial-flow fan apparatus F can be prevented by the magnetic seal name plate 31.

Figure 3:
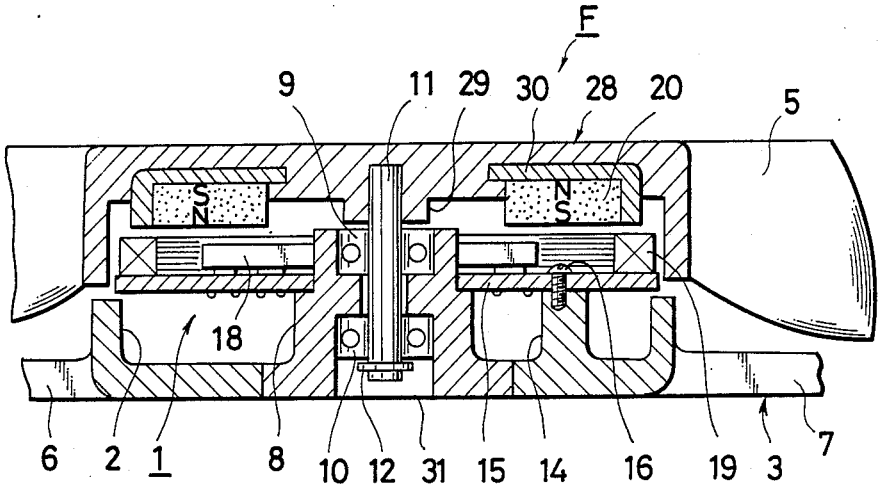
FIG. 3 is a vertical sectional view of a flattened single-phase energized coreless brushless motor incorporated in the axial-flow fan apparatus of FIG. 1.
Figure 4:
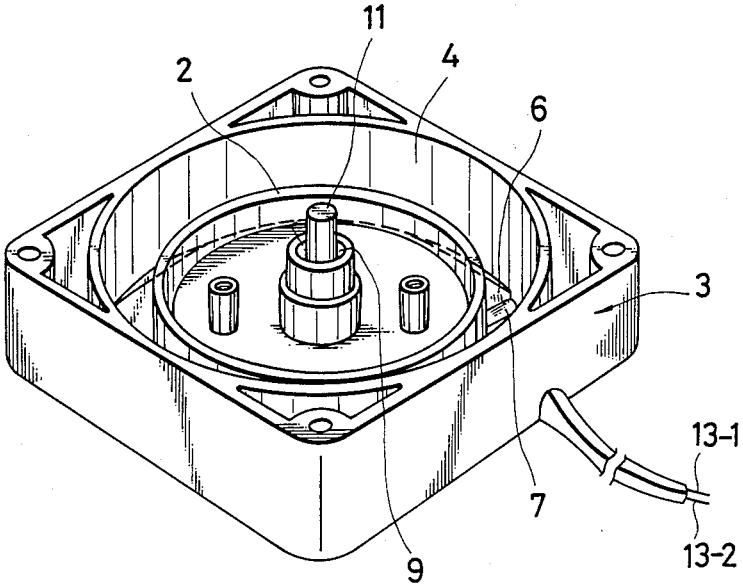
FIG. 4 is a perspective view, in a reduced scale, of a square for casing of the axial-flow fan apparatus of FIG. 3.
Figure 5:
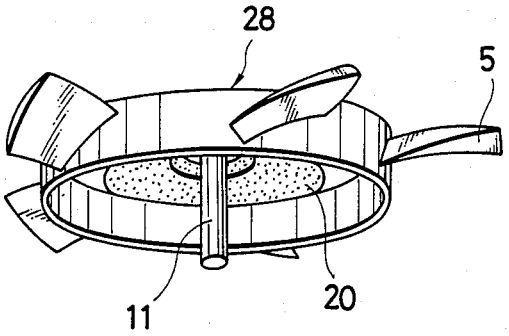
FIG. 5 is a perspective view of a cup member with fan blades of the axial-flow fan apparatus of FIG. 3.

Referring now to FIG. 3, the axial-flow fan apparatus F includes a flattened single-phase coreless brushless motor 1 installed in the motor casing 2 and having no stator yoke therein. The axial-flow fan apparatus F further includes an axially flattened angular case 3 as seen in FIG. 4 which is made of a non-magnetic material such as a resin or aluminum. The cup-shaped motor casing 2 is formed in an integral relationship with and located via a stay 7 inside the fan casing 3 with a spacing 4 left therebetween in which a plurality of fan blades 5 (see FIGS. 3 and 5) provided on a fan or cup member 28 are accommodated. A plurality of stays 7 extend between and interconnect the cup-shaped motor casing 2 and the fan casing 3, and a same number of windows 6 are defined by the stays 7 between the cup-shaped motor casing 2 and the fan casing 3.

A bearing holder 8 made of, for example, a magnetic material (only upper part of the bearing holder 8 may be made of a magnetic material) is secured substantially at the center of the casing 2 and constitutes a body of the apparatus together with the casing 2 and the fan casing 3. A pair of journal bearings 9, 10 are securely received in openings at upper and lower ends of the bearing holder 8, and a rotary shaft 11 is supported for rotation substantially at the center of the flattened coreless brushless motor 1 by means of the journal bearings 9, 10. An E-snap ring 12 is mounted at a lower end portion of the rotary shaft 11 for preventing the rotary shaft 11 from being pulled off upwardly. A pair of positive and negative power supply codes 13-1, 13-2 extend from the fan casing 3 for connection with an external power source such as a commercial power supply.

A pair of support posts 14 (only one is shown) extend upwardly from and are formed in an integral relationship with the casing 2 and in a spaced relationship from each other by an angular distance of about 180 degrees around the center of the motor 1. A printed circuit board 15 is secured at the top of the support posts 14 by means of screws 16 made of a non-magnetic material. A single armature coil 19 and a magnetoelectric transducer 17 such as a Hall effect element as shown in FIG. 6 is mounted on an upper face of the printed circuit board 15, but no stator yoke is mounted on the lower face of the printed circuit board 15.

If a stator yoke is otherwise located on the lower face of the printed circuit board 15, a more intense magnetic field can be obtained accordingly. However, since this will cause the magnetoelectric transducer 17 used as a position detecting element to develope a square wave as an output therefrom and hence the armature coil will be energized with such a square wave, disagreeable high turning noises will be produced due to rapid switching of energization. Therefore, only the printed circuit board 15 is used, without using a stator yoke, to round the output of the magnetoelectric transducer 17 into a sinusoidal wave in order to energize the armature coil 19 with a sinusoidal wave to prevent production of high turning noises. In consideration of the possibility that a high magnetic field may not be obtained due to the absence of a stator yoke, the specifications of a winding of an armature coil were actually changed suitably. Consequently, a flattened coreless brushless motor was obtained wherein energization current was reduced while the rotational frequency was raised. Besides, due to the absence of a stator yoke, an axial-flow fan apparatus can be advantageously obtained which is lower in cost, smaller in thickness and lighter in weight accordingly. Besides, it can be readily mass-produced because the time-consuming step of assembling a stator yoke to the printed circuit board can be omitted.

Figure 6:
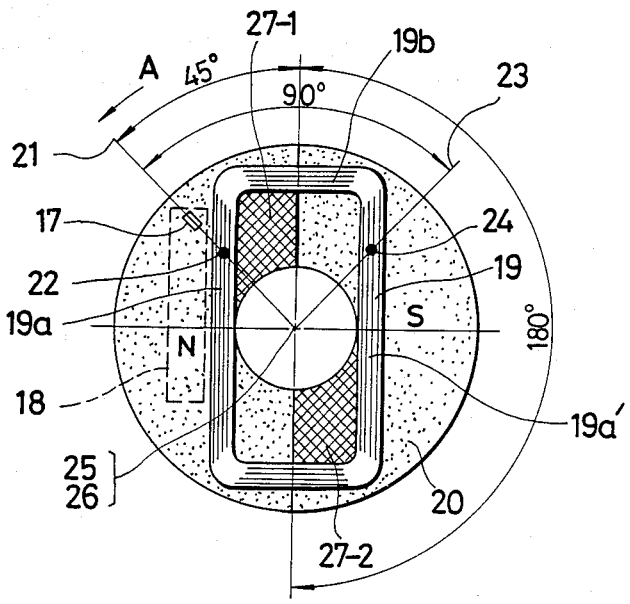
FIG. 6 is a schematic illustration of a 2-pole field magnet in relation to a coreless armature forming its associated stator armature coil of the motor of FIG. 3.

Referring now to FIG. 6, the armature coil 19 has a configuration of a rectangular frame and has a pair of magnetically active conductor portions 19*a*, 19*a*' which contribute to generation of a torque and constitute longer sides of the rectangular frame having a length a little smaller than a diameter of a field magnet 20. In particular, in the armature coil 19, an angular width or distance between a central point 22 of the magnetically-active conductor portion 19*a* on a radial center line 21 and another central point 24 of the other magnetically-active conductor portion 19*a*' on another radial center line 23 is about one half of the angular width of each pole of the field magnet 20, that is, substantially 90 degrees because the field magnet 20 is a 2-pole annular magnet having 2 N (north) and S (south) magnetic poles or pole zones each having an angular width of 180 degrees as seen in FIG. 6.

The armature coil 19 is suitably secured by adhesion to the printed circuit board 15 with its center 25 registered with a point 26 of the center axis of the rotary shaft 11 as seen in FIG. 6. A stator armature thus constituted by the printed circuit board 15 and the armature coil 19 secured to the upper face of the printed circuit board 15 is located in a face-to-face opposing relationship to the field magnet 20 as shown in FIG. 3. As the armature coil 19 is secured by adhesion to the printed circuit board 15 as shown in FIG. 3, a sufficient space of locating electric parts other than the armature coil 19 can be left on the face of the printed circuit board 15, as is apparent from FIG. 6. Accordingly, an IC (integrated circuit) chip 18, wherein the magnetoelectric transducer 17 serving as a position detecting element and a driving circuit are formed as an integral integrated circuit, is located in the space on the printed circuit board 15 as seen in FIGS. 3 and 6. It is to be noted that a pair of substantially circumferentially extending conductor portions 19*b* of the armature coil 19 do not normally contribute to generation of a torque but may possibly function as magnetically active conductor portions depending upon its relative position to the field magnet 20.

A pair of cogging generating magnetic members 27-1, 27-2 are suitably located on the face of the printed circuit board 15 so that the field magnet may be stopped at a position from which it can start itself even if the motor 1 includes the only one magnetoelectric transducer 17. Preferably, the cogging generating magnetic members 27-1, 27-2 are each located at a position within a range from a position corresponding to the magnetically active conductor portion 19*a* or 19*a*′ of the armature coil 19 to a position spaced forwardly by a distance equal to about one half, more preferably about one fourth to one third or so, of the angular width of each pole of the field magnet 20 toward a direction of rotation of the field magnet 20 (in a direction indicated by an arrow mark A). In the arrangement shown in FIG. 6, the cogging generating magnetic members 27-1, 27-2 having an angular width of about 45 degrees are securely mounted on the face of the printed circuit board 15 such that they may each extend rearwardly in the direction of rotation of the field magnet 20 (in the direction of the arrow mark A) from a position adjacent the magnetically active conductor portion 19*a*, 19*a*′ of the armature coil 19. Thus, the cogging generating magnetic members 27-1, 27-2 have a function to position the armature coil 19.

The cogging generating magnetic members 27-1, 27-2 may otherwise be attracting and repulsing torque generating permanent magnets with their N and S poles directed or opposed to the field magnet 20. Where such attracting and repulsing torque generating permanent magnets are employed instead of the cogging generating magnetic members, the field magnet 20 will stop always at a predetermined fixed position. Accordingly, energization of the armature coil 19 in a predetermined direction will cause the field magnet 19 to start itself and rotate in a predetermined direction. Therefore, if a back electromotive force of the armature coil 19 is utilized as a position detecting signal without employing a magnetoelectric transducer as a position detecting element, a more inexpensive axial-flow fan which can start itself and thereafter continue its rotation can be constructed without a magnetoelectric transducer. Further, if the screws 16 for fastening the printed circuit board 15 at the top of the support posts 14 are otherwise made of a magnetic material, the cogging generating magnetic members 27-1, 27-2 may be replaced by the screws 16.

Thus, the 1-phase energized coreless brushless motor 1 is constituted so as to allow self-starting thereof with the single magnetoelectric transducer 17 by locating the cogging generating magnetic members 27-1, 27-2 at such positions on the printed circuit board 15 [that the field magnet 20 may stop at a position in which the field magnet 20 can be attracted by the projections] to allow self-starting of the field magnet 20, that is, at a position in which the magnetoelectric transducer 17 does not detect any dead point. Alternatively or additionally, the printed circuit board 15 can be fixed, the board 15 serving as a stator armature and carrying the armature coil 19 by magnetic screws 16 in the top of support posts 14, at such a position that field magnet 20 may stop at a position where fields magnet 20 can be attracted by either one or both of the cogging generating magnetic member 27-1, 27-2 and/or the magnetic screws 16. If the cogging generating magnetic members 27-1, 27-2 are located so that a maximum starting torque may be generated upon starting of the motor, a considerable loss will appear upon starting of the motor and hence a motor of the possible highest efficiency cannot be obtained. Therefore, the cogging generating magnetic members 27-1, 27-2 are located at such specific positions as described above so that a maximum starting torque may be produced only after a little motion of the field magnet 20.

The top end of the rotary shaft 11 is secured to a hub 29 of the fan or cup member 28 with fan blades 5 made of a resin material so that it may rotate in an integral relationship with the field magnet 20 which is secured at its upper face to the cup member 28 with a rotor yoke 30 interposed therebetween. Thus, as the cup member 28 rotates, a wind is blown through the windows 6 by the fan blades 5 thereof.

What is claimed is:

1. An axial-flow fan apparatus, said apparatus comprising:

a fan casing;

a motor casing made of a resin and formed integrally with said fan casing and arranged inside said fan casing, said fan casing and said resin motor casing having stays interposed therebetween;

a flattened single-phase energized coreless brushless motor housed within said motor casing, said motor being capable of self-starting through the use of a cogging torque, said motor including a printed circuit board, an air-core type armature coil disposed on said circuit board, a stator armature without a stator yoke arranged on one side of said circuit board, and a rotatable field magnet spaced from said stator armature; and a magnetic seal name plate having desired indications legible on one side thereof, the other side of said name plate being adhesively coupled to the outer bottom face of said motor casing, said name plate preventing axial leakage of magnetic flux from said field magnet of said flattened coreless brushless motor.

* * * * *